United States Patent [19]

Munekata et al.

[11] 4,432,652

[45] Feb. 21, 1984

[54] TIMER APPARATUS

[75] Inventors: Katsusuke Munekata, Kanagawa; Hiroshi Furuno; Noboru Someno, both of Tokyo, all of Japan

[73] Assignee: Sony Corporation, Tokyo, Japan

[21] Appl. No.: 233,389

[22] Filed: Feb. 11, 1981

[30] Foreign Application Priority Data

Feb. 20, 1980 [JP] Japan ..... 55-19858

[51] Int. Cl.[3] ..... G04C 17/00; G04F 8/00

[52] U.S. Cl. ..... 368/69; 368/74; 368/108

[58] Field of Search ..... 368/69, 70, 72–74, 368/82, 107–113, 185, 187, 239, 281, 308

[56] References Cited

U.S. PATENT DOCUMENTS

| | | | |
|---|---|---|---|
| 3,768,247 | 10/1973 | Fujita | 368/187 |
| 4,055,755 | 10/1977 | Nakamura et al. | 368/223 |
| 4,068,495 | 1/1978 | Bacon | 368/82 |
| 4,085,575 | 4/1978 | Tanaka | 368/239 |
| 4,178,751 | 12/1979 | Liautaud | 368/281 |
| 4,257,115 | 3/1981 | Hatuse et al. | 368/251 |
| 4,283,782 | 8/1981 | Tamaru et al. | 368/72 |
| 4,338,681 | 7/1982 | Bapp et al. | 368/72 |

*Primary Examiner*—Vit W. Miska

*Attorney, Agent, or Firm*—Hill, Van Santen, Steadman & Simpson

[57] ABSTRACT

A timer apparatus is provided such that an operation of switches for setting a timer working hour makes it possible to memorize the timer working hour in a timer circuit and also to display this timer working hour in a digital time display device, and, to obtain an output when this timer working hour arrives. In this timer apparatus, the switches for setting a timer working hour are composed of twelve switches disposed at a positional relation corresponding to 1 o'clock to 12 o'clock on the dial plate of a clock.

5 Claims, 4 Drawing Figures

TIMER APPARATUS

BACKGROUND OF THE INVENTION

1. Field of the Invention

This invention relates mainly to a timer apparatus, and particularly to a timer apparatus in which twelve switches for setting a timer working hour are disposed at a positional relation of 1 o'clock, 2 o'clock, . . . 12 o'clock on the dial plate of a clock.

2. Description of the Prior Art

FIG. 1 shows one example of a prior art electronic type digital-display timer apparatus, in which reference numeral 1 designates a cabinet of the apparatus, and 2 a display device disposed at a front plate 1*a* of the cabinet 1 for digitally displaying either the present time or timer working hour. Further, reference character $S_w$ indicates a lever-type MODE switch for changing-over the display contents of the display device 2 to the present time or timer working time, $S_h$ a push switch for setting "HOUR", $S_m$ a push switch for setting "MINUTE", $S_c$ a safety switch consisting of a push switch which can adjust the present time only during a time interval when this safety switch $S_c$ is being pushed, and $S_t$ a lever-type TIMER change-over switch. The switch $S_h$ or $S_m$ is arranged to advance the time by "one hour" or "one minute" at every push thereof.

Also, reference numeral 3 repesents a power supply cord which is led out from a left side plate 1*b* of the cabinet 1 in this example and connected to a commercial AC power source for actuating the timer apparatus, and 4 a plug socket provided at a right side plate 1*c* of the cabinet 1 for being connected with a power supply cord of an electric equipment which is to be controlled by the timer apparatus as to power supply to it. Reference character $S_t$ indicates a lever-type TIMER change-over switch.

With the timer apparatus mentioned above, the timer operation is set in the following manner.

(a) The MODE switch $S_W$ is changed over to a TIMER SET display position side to make the display device 2 in a mode of displaying a timer working hour.

(b) Each push of the hour switch $S_h$ makes the "hour" in the display device 2 large by every "1" so that the hour switch $S_h$ is pushed several times while looking at the display device 2 until it reaches an "hour" of the desired timer working hour.

(c) The minute switch $S_m$ is operated in the same manner as above.

(d) After the desired time has been displayed, the MODE switch $S_w$ is changed over to the side of present time, or the CLOCK display position side, to make the display device 2 in a mode of displaying the present hour.

(e) The timer change-over switch $S_t$ is changed over to the AUTO display position side.

Thus, setting of the timer is completed. Then, when it reaches the above set time, the timer is turned on to supply its output.

The present time can be corrected by operating the switches $S_h$ and $S_m$ according to the above steps (b) and (c) with the safety switch $S_c$ being kept pushed. When the timer operation is not required, the timer change-over switch $S_t$ is previously changed over to the EVER ON side.

Accordingly, with the timer of this kind, when the timer working hour is to be set, the adjustment is visually troublesome and also the operation is quite complicated and takes much time due to the steps (b) and (c).

For example, when the timer working hour, which has been set to 7:00 p.m., is going to be changed to 6:45 p.m., it is required to push the hour switch $S_h$ 23 times and then the minute switch $S_m$ 45 times. In addition, if the switch $S_h$ or $S_m$ is erroneously operated to make one excessive push, the switch $S_h$ or $S_m$ must be pushed again many times. It is also troublesome when the timer working hour is changed very often.

Such a timer is also available that the number indicating "hour" or "minute" is advanced at a constant speed during a time period when the switch $S_h$ or $S_m$ is being continuously pushed. In this case, however, setting of the timer working hour is also complicated.

SUMMARY OF THE INVENTION

Accordingly, it is an object of this invention to provide a timer apparatus which is free from the drawbacks inherent to the prior art timer apparatus.

It is another object of this invention to provide a timer apparatus in which setting of a timer working hour is visually easy to operate.

It is a further object of this invention to provide a timer apparatus which can perform the setting of a timer working hour in a short time.

According to one aspect of this invention, a timer apparatus is provided with twelve switches for setting a timer working hour which are disposed according to the positional relation of 1 o'clock, 2 o'clock, . . . 12 o'clock on the dial plate of a clock, and also switches for changing-over a.m. (before noon) and p.m. (afternoon).

The above and other objects, features and advantages of the present invention will be apparent from the following description taken in conjunction with the accompanying drawings.

DESCRIPTION OF THE PREFERRED EMBODIMENTS

Figure 1:
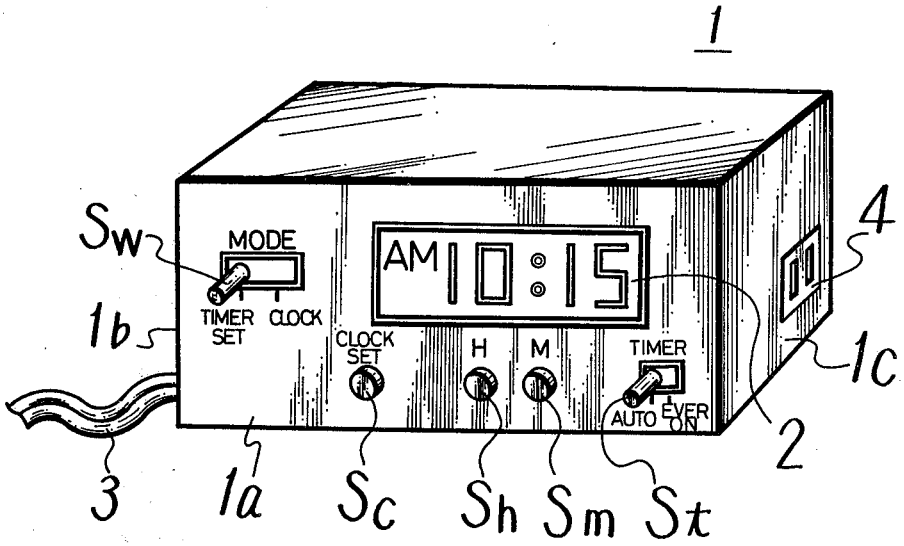
FIG. 1 is a perspective view used for explaining a prior art electronic-type timer apparatus for displaying a digital hour.

One embodiment of this invention will hereinafter be described with reference to FIG. 2, in which elements corresponding to those of FIG. 1 are indicated by the same references with their detailed explanation being omitted.

At first, twelve switches $S_1$ to $S_{12}$ are disposed on a loop, for example, on a circle in this example, at respective positions corresponding to 1 o'clock, 2 o'clock, . . . , 12 o'clock on the dial plate of an analog clock or a pointer-type clock. In this case, the switches $S_1$ to $S_{12}$ function to deliver informaion data as to "hour" and "minute" of both the timer working hour and present hour. By way of example, the switch $S_1$ delivers the information of "one o'clock" at an input mode of "hour" and the information of "five minute" at an input mode of "minute".

Within the circle formed by the switches $S_1$ to $S_{12}$ are respectively disposed switches $S_a$ and $S_p$ for before noon (AM) and afternoon (PM), and a minute switch $S_{01}$ for one minute. These switches $S_1$ to $S_{12}$, $S_a$, $S_p$ and $S_{01}$ are each provided with a push-operating portion which is molded integrally and continuously in a projecting manner by using elastic material such as rubber, soft synthetic resin or the like, and each push-operating portion is projected through a penetrating bore of the front plate 1*a* and exposed on the surface of the front plate 1*a*. On the rear surface of each push-operating portion is attached a conductive thin plate, which is opposed to a corresponding contact on a printed-circuit base plate, thus a predetermined pattern being formed thereon by respective contacts. These switches $S_1$ to $S_{12}$, $S_a$, $S_p$ and $S_{01}$ are of non-locked push switch type wherein the contact with each other according to the elasticity of the material of the push-operating portions.

On the surface of the front plate 1*a*, numerals $C_h$ of "1", "2", . . . , "11", "12", each for indicating an "hour" and numerals $C_m$ of "5", "10", . . . , "55", and "0", each for indicating a corresponding "minute" are respectively marked in the vicinity of respective push-operating portions of the switches $S_1$ to $S_{12}$. Also, near the switches $S_a$ and $S_p$ are respectively marked letters "AM" and "PM", and near the switch $S_{01}$ is marked a letter of "ONE MINUTE". In addition, at the center of the circle of the switches $S_1$ to $S_{12}$ are provided a digital time display device 2 made of phosphor display tubes, crystalline liquid, light emitting diodes (LEDs), etc., and also LEDs $L_h$ and $L_m$ for indicating respective input modes. A capital letter "H" of HOUR and a capital letter "M" of MINUTE are respectively marked near the LEDs $L_h$ and $L_m$. On the front plate 1*a* are also provided a mode switch $S_W$, a timer switch $S_t$ and a set switch $S_S$, each consisting of a push-push switch.

Figure 3:
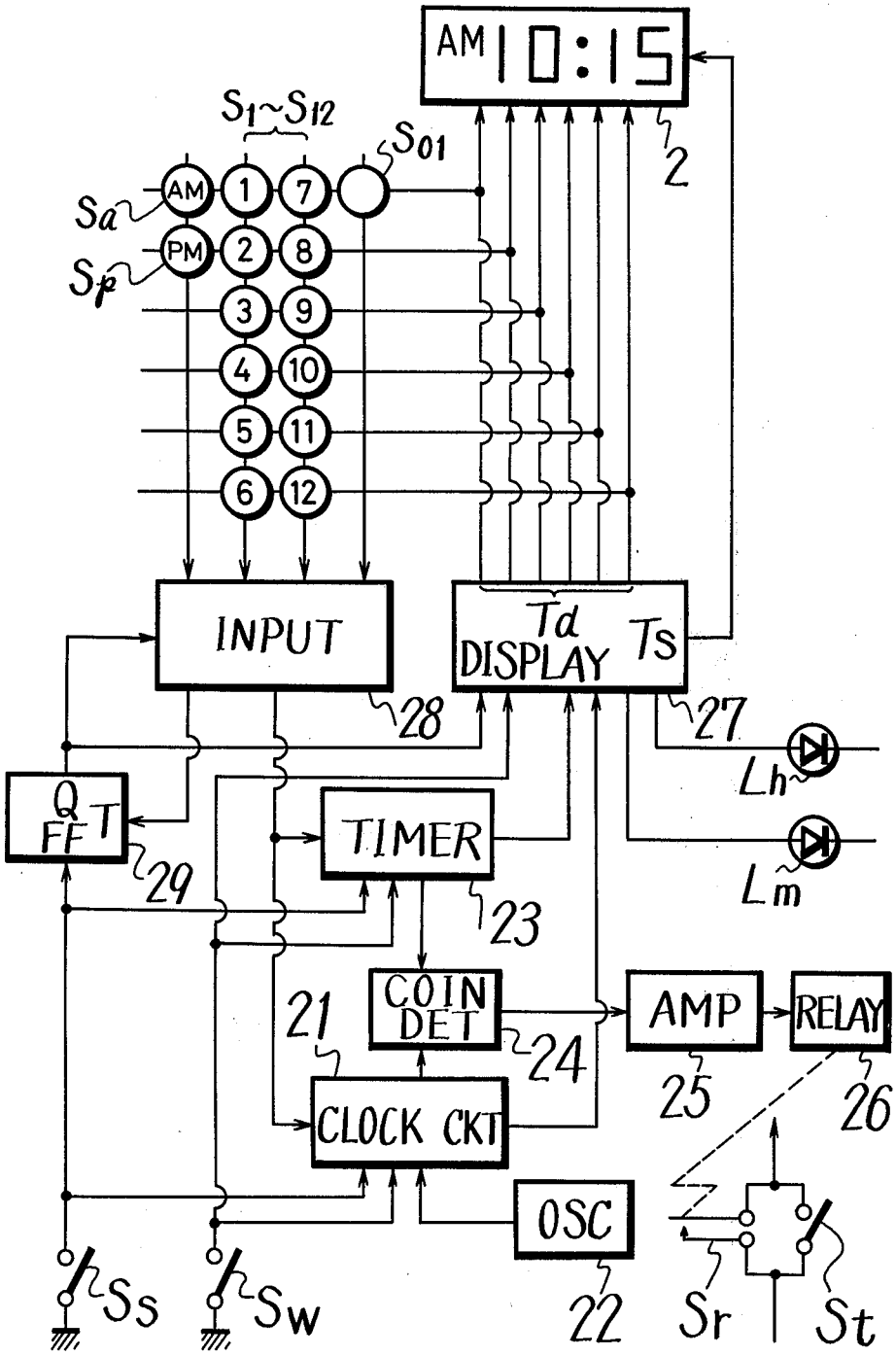
FIG. 3 is a schematic view showing the above timer apparatus of this invention.

The circuit for the above timer is formed as shown in FIG. 3, by way of example. In FIG. 3, reference numeral 21 designates a clock circuit which counts (frequency-divides) clock pulses used as the reference of time, 22 an oscillator circuit which generates the above clock pulses, and 23 a timer circuit which stores or memorizes a timer working hour. Reference numeral 24 indicates a coincidence detector circuit, which is fed with both outputs of the clock circuit 21 and the timer circuit 23 to produce a detected output when the both outputs are coincident with each other. This detected output is "1" in level only during a time interval of, for example, one hour from the above coincidental time point. The detected output from the detector 24 is supplied through an amplifier 25 to a relay 26. A normally-open contact $S_r$ of the relay 26 is connected in parallel with the timer switch $S_t$.

Reference numeral 27 represents a display circuit, which is fed with the outputs of the clock circuit 21 and timer circuit 23 to deliver digit outputs from its terminal $T_d$ at different time points or in a time dividing manner and also a segment output from its terminal $T_s$ in a time dividing manner. These outputs are supplied to the digital hour display device 2 to display either the present time or the timer working hour in a time dividing manner and in a digital manner.

Reference numeral 28 designates an input circuit, which is connected to the switches $S_1$ to $S_{12}$, $S_a$, $S_p$ and $S_{01}$ in a matrix mode. The digit outputs of the display circuit 27 are also fed to these switches $S_1$ to $S_{12}$, $S_a$, $S_p$ and $S_{01}$, the outputs of which are fed to the input circuit 28 in a time dividing manner. The output of the input circuit 28 is then supplied to the timer circuit 23 and the clock circuit 21, respectively.

The circuits 21, 23 and 27 are also supplied with the output of the mode switch $S_w$ so that, for example, when the switch $S_w$ is set at the present time side or CLOCK side (OFF), the output of the input circuit 28 is received in the clock circuit 21 but not in the timer circuit 23, and when the switch $S_w$ is set at the TIMER SET side (ON), the same is reversely received in. While, when the switch $S_w$ is set at the present time side, the output of the clock circuit 21 is received in the display circuit 27 but the output of the timer circuit 23 is not received and when the switch $S_w$ is set at the TIMER SET side, the above relation is severed.

The clock circuit 21 and the timer circuit 23 are also applied with the output of the set switch $S_s$, so that the output of the input circuit 28 is not received therein when the switch $S_s$ is OFF.

The output of the switch $S_s$ is also supplied to, for example, a T-flip-flop circuit 29 as its reset input and its Q-output is supplied to the input circuit 28 as its mode setting signal. Thus, the mode of the input circuit 28 is controlled so as to receive the output of the switches $S_1$ to $S_{12}$ as a signal of "hour" when Q="0" and to receive the same as a signal of "minute" when Q="1". Then, when the input circuit 28 receives any output of the switches $S_1$ to $S_{12}$, a T-input signal is supplied from the input circuit 28 to the flip-flop circuit 29.

In the case of receiving an output of the switch $S_{01}$ in the clock circuit 21 and the timer circuit 23 through the input circuit 28, the number of times the switch $S_{01}$ is to be pushed is received. Further, the Q-output of the flip-flop circuit 29 is supplied to the display circuit 27 while the display circuit, 27 delivers its mode outputs to the LEDs $L_h$ and $L_m$.

With the arrangement mentioned above, the timer working hour can be set to, for example, a quarter past ten in the moring (10:15 a.m.) according to the following steps:

(1) The push-operating portion of the mode switch $S_w$ is pushed down and changed over to the TIMER SET display side.

(2) The push-operating portion of the set switch $S_s$ is pushed down to ON.

(3) The push-operating portion of the AM switch $S_a$ is pushed.

The push-operating portion of 10-o'clock switch $S_{10}$ is pushed.

The push-operating portion of 15-minute switch $S_3$ is pushed.

(4) The push-operating portion of the set switch $S_s$ is further urged and lifted up to turn it off.

(5) The push-operating portion of the mode switch $S_w$ is further urged and lifted up to return it to the CLOCK display side.

(6) The push-operating portion of the timer switch $S_t$ is urged to change it over to the AUTO side.

Thus, the timer working hour is completely set to 10:15 a.m. With respect to the above switch movement of the steps (1) to (6), the operation will be described below.

(1) When the mode switch $S_w$ is changed over to the TIMER SET display side, the output of this switch $S_w$ is fed to the clock circuit 21 and the timer circuit 23 so that the former may not receive the output of the input circuit 28 and the latter may receive the same.

Further, the display circuit 27 will bein a mode for receiving the output of the timer circuit 23 and hence the output of the timer circuit 23 is supplied through the display circuit 27 to the display device 2. As a result, the timer working hour stored in the timer circuit 23 is displayed in the display device 2.

(2) When the switch $S_s$ is turned ON, the output of this switch $S_s$ is fed to the flip-flop circuit 29 to reset it, while its Q-output is fed to the input circuit 28 so that it may be in a mode for receiving any output of the switches $S_1$ to $S_{12}$ as a signal of "hour".

The Q-output of the flip-flop circuit 29 is also supplied to the display circuit 27 so that the LED $L_h$ exhibits its on-and-off state (the LED $L_m$ is turned off). Accordingly, the above on-and-off state proves that when any of the switches $S_1$ to $S_{12}$ is pushed, this switch operation is taken into the input circuit 28 as an input of "hour", or an input of "hour" is being required.

Further, the output of the switch $S_s$ functions to provide the timer circuit 23 with a mode of receiving the output of the input circuit 28.

(3) When the AM switch $S_a$ is pushed, the output of this switch $S_a$ is fed through the input circuit 28 to the timer circuit 23 where "AM" is stored therein. At the same time, "AM" is displayed in the display device 2, for example, at its left upper side by the display circuit 27.

Then, when the 10-o'clock switch $S_{10}$ is pushed, the output of this switch $S_{10}$ is supplied through the input circuit 28 to the timer circuit 23. In this case, the input circuit 28 is provided with the mode of receiving the output of the switch $S_{10}$ as a signal of "hour" by the Q-output of the flip-flop circuit 29, so that "10 o'clock" is stored in the timer circuit 23. At the same time, the display circuit 27 drives the display device 2 to display "10" at its predetermined position.

Further, when the switch $S_{10}$ is pushed, a signal is supplied from the input circuit 28 to the flip-flop circuit 29 to invert its Q-output to "1". Accordingly, the input circuit 28 is ready for receiving an output of the switches $S_1$ to $S_{12}$ as a signal of "minute". This Q-output is also fed to the display circuit 27 so that the LED $L_m$ is then driven in place of the LED $L_n$ to make the LED $L_m$ in its on-and-off state (the LED $L_h$ is turned on). As a result, it is proved that when any of the switches $S_1$ to $S_{12}$ is next pushed, this switch operation is taken into the input circuit 28 as an input of "minute".

Next, when the 15-minute switch $S_3$ is pushed, its output is supplied through the input circuit 28 to the timer circuit 23. In this case, the input circuit 28 is ready for receiving the output of the switch $S_3$ as the signal of "minute" according to the operation of the Q-output of the flip-flop circuit 29, so that "15-minute" is stored in the timer circuit 23. Also, the display circuit 27 drives the display device 2 to display "15" at its proper position.

Thus, the timer working hour is completely set to display in the display device 2 the timer working hour, that is, "AM 10:15".

(4) When the set switch $S_s$ is turned off, the timer circuit 23 will not be ready for receiving the output of the input circuit 28.

(5) When the mode switch $S_w$ is returned to the "CLOCK" side, the output of the switch $S_w$ controls the display circuit 27 to have a mode of receiving the output of the clock circuit 21. Therefore, the output of the clock circuit 21 is supplied through the display circuit 27 to the display device 2 so that the present time is displayed in the display device 2.

(6) When the timer switch $S_t$ is changed over to the AUTO side (OFF), the output of the coincidence detector circuit 24 is "0" and the contact $S_r$ of the relay 26 is also off at this time, so that the time output will not appear.

Thus, the setting operation of the timer working hour, is over. In case of setting the timer working hour to, for example, 17 minutes past 10 o'clock in the working (10:17 a.m.), at the step (3) the switch $S_3$ is pushed and thereafter the switch $S_{01}$ is pushed twice. Thus, "17" minute is set as $15+1+1=17$.

Meanwhile, when it reaches the timer working hour, or 10:15 a.m., the output of the clock circuit 21 coincides with the output of the timer circuit 23, and this coincidence is detected by the detector 24 so that its detected output keeps a value of "1" for one hour until 11:15 a.m., by way of example. The detected output is applied through the amplifier 25 to the relay 26 to drive it so that the contact $S_r$ is in ON-state until 11:15 a.m. Thus, the timer output is obtained for one hour from the timer working hour to energize a load (not shown).

In order to correct the present hour of the clock, the operations of the steps (2), (3) and (4) are carried out when the mode switch $S_w$ is at the CLOCK side.

Setting of the timer working hour and its timer operation are carried out as mentioned above. In this case, according to this invention, as described in the step (3), it is sufficient to push switches corresponding to a desired timer working hour, or the switches $S_a$, $S_{10}$ and $S_3$ only in case of, for example, 10:15 a.m., so that setting of the timer working hour becomes very simple. In other words, the switches $S_{10}$ and $S_3$ corresponding to 10-o'clock and 15-minutes are disposed at the positions of 10 o'clock and 15 minutes of an analog clock, and it is enough to push these switches $S_{10}$ and $S_3$ each one time, so that the operation is quite simple. In addition, any strange feeling is minimized from the sensual point of view.

When the timer working hour is to be changed very often, it is also sufficient to push predetermined ones of the switches $S_1$ to $S_{12}$, $S_a$, $S_p$ and $S_{01}$ several times only so that a convenient system is provided.

In case of recording, for example, a radio broadcasting wave, since a regular program normally starts at 0, 15, 30 or 45 minute, the switches $S_1$ to $S_{12}$ are sufficient at every unit of 5 minutes so that they will not be erroneously pushed. In case of other hours, the timer working hour can be set at a unit of 1 minute by using the switch $S_{01}$ in addition to the switches $S_1$ to $S_{12}$.

Figure 2:
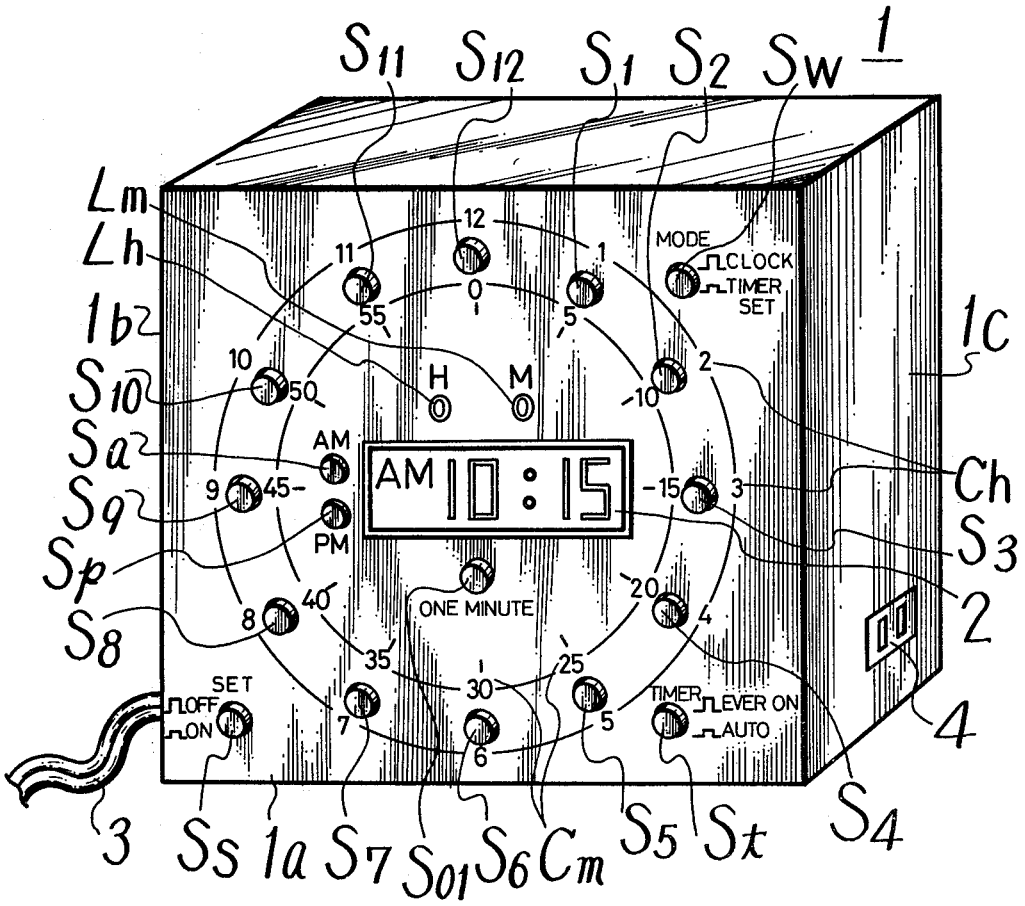
FIG. 2 is a perspective view showing one embodiment of an electronic-type timer apparatus for displaying a digital hour according to this invention.
Figure 4:
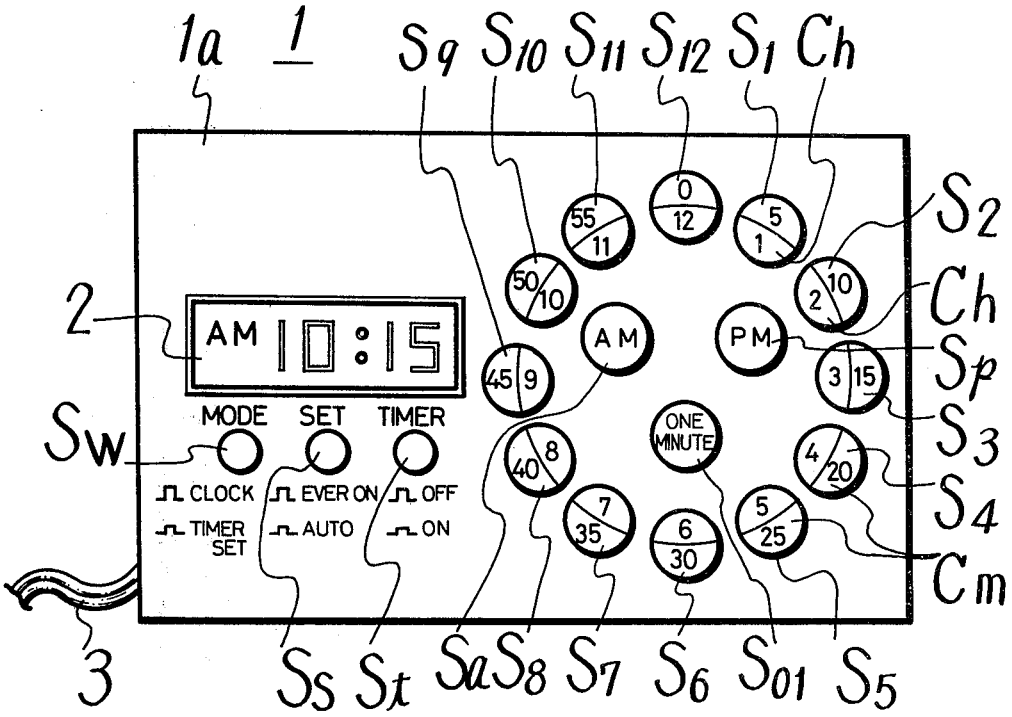
FIG. 4 is a front view showing another embodiment of the electronic-type timer apparatus of this invention.

FIG. 4 shows another embodiment of this invention, in which elements corresponding to those of FIG. 2 are indicated by like reference numerals and characters with their description being omitted.

In FIG. 4, the digital hour display device 2 is disposed outside the loop of the switches $S_1$ to $S_{12}$, and the push-operating portion of each of the switches $S_1$ to $S_{12}$ and $S_{01}$ is marked on its surface with corresponding numerals and letters. Portions of the switches $S_1$ to $S_{12}$ marked with numerals $C_m$ corresponding to "minute" are the same in color as a portion of the switch $S_{01}$ marked with legend "ONE MINUTE", while portions of the switches $S_1$ to $S_{12}$ marked with numerals $C_h$ corresponding to "hour" are different in color from the former portions. Accordingly, the above coloring makes the operations of the switches $S_1$ to $S_{12}$ distinguishable.

In this embodiment, if the output of the mode switch $S_w$ is supplied to the flip-flop circuit 29 as its reset input, when this switch $S_w$ is changed over to the TIMER SET side, the input circuit 28 can be ready for receiving an output of the switches $S_1$ to $S_{12}$ as its input of "hour". In this case, the operations of the steps (2) and (4) are not required. (In case of correcting the present hour, it is similar to the foregoing).

The switches $S_1$ to $S_{12}$, $S_a$, $S_p$ and $S_{01}$ may be of a touch type. That is, the surfaces of the push-operating portions of these switches are made of metal and when any of these switches $S_1$ to $S_{12}$, $S_a$, $S_p$ and $S_{01}$ is touched by a human body, an induced current flows therethrough so that a timer working hour can be set. The switches $S_1$ to $S_{12}$, $S_a$, $S_p$ and $S_{01}$ can also be made of a self-luminous push-type. In other words, a light-emitting device is incorporated in each of these switches and the push-operating portion of a pushed switch is illuminated. Further, in case of using the above self-luminous type switches, it is also possible that with LEDs capable of illuminating in for example, red color and green color, and such colors being incorporated in respective switches $S_1$ to $S_{12}$ in advance, the push-operating portion of a switch pushed in setting "hour" is illuminated in, for example, red color and the push-operating portion of a switch pushed in setting "minute" is illuminated in green color.

In setting the timer working hour, the on-and-off conditions of LEDs $L_h$ and $L_m$ can be replaced by the on-and-off conditions of the AM, PM, hour and minute display portions of the display device 2. Further, the hour display of the display device 2 can be displayed as a 24-hour system.

It will be apparent to those skilled in the art that many modifications and variations may be effected without departing from the spirit and scope of the novel concepts of the present invention.

We claim as our invention:

1. A timer apparatus, comprising: a digital time and timer setting display means; circuit means including a plurality of switches for setting a timer working hour; a timer circuit; said switches being connect to operably memorize a timer working hour in said timer circuit and the digital time display means being made indicatable of a timer working hour so that a timer output is obtainable when it reaches the timer working hour; said switches being provided as first through twelfth switches, inclusive, disposed at a positional relation corresponding to one o'clock to twelve o'clock on a dial plate of a clock; switch means for changing-over before noon and afternoon operation; each of the first through twelfth switches corresponding to a respective one through twelve o'clock working hour setting corresponding to the positional relation; said digital time display means being encircled by said first to twelfth switches; a mode change-over means having first and second modes, and when any of said first to twelfth switches is operated in the first mode, an "hour" input corresponding to a position of said operated switch is memorized in said timer circuit as the "hour" of the timer set hour, and when any of said first to twelfth switches is operated with the second mode, a "minute" input corresponding to a position of said operated switch is memorized in said timer circuit as a "minute" setting; a one-minute switch and a value of the "minute" setting being increased by a number of times said one-minute switch is operated, the "minute" setting being memorized in said timer circuit; and a light emitting device which is luminous when an "hour" of the timer working hour is being set and a light-emitting device which is luminous when a "minute" of the timer working hour is being set.

2. A timer apparatus as set forth in claim 1, wherein said first to twelfth switches and said switch means for the before noon and the afternoon operation are of push type with push-operating portions thereof being formed in a continuous and integral mold by an elastic material.

3. A timer apparatus as set forth in claim 1, wherein said first to twelfth switches are respectively marked with both of 1, 2, . . . , 11, 12 corresponding to the "hour" of a clock and 5, 10, . . . , 55, 0 corresponding to the "minute" thereof one by one in sequence.

4. A timer apparatus, comprising: a digital time and timer setting display means; circuit means including a plurality of switches for setting a timer working hour; a timer circuit; said switches being connected to operably memorize a timer working hour in said timer circuit and the digital time display means being made indicatable of a timer working hour so that a timer output is obtainable when it reaches the timer working hour; said switches being provided as first through twelfth switches, inclusive, disposed at a positional relation corresponding to one o'clock to twelve o'clock on a dial plate of a clock; switch means for changing-over before noon and afternoon operation; each of the first through twelfth switches corresponding to a respective one through twelve o'clock working hour setting corresponding to the positional relation; a mode change-over means having first and second modes, and when any of said first to twelfth switches is operated in the first mode, an "hour" input corresponding to a position of said operated switch is memorized in said timer circuit as the "hour" of the timer set hour, and when any of said first to twelfth switches is operated with the second mode, a "minute" input corresponding to a position of said operated switch is memorized in said timer circuit as a "minute" setting; and two kinds of light-emitting devices being incorporated in each of said first to twelfth switches for illuminating a push-operating portion which is operated when a timer working hour is set so that the push-operating portion is luminous in one of two kinds of colors according to whether the switch is being used to input "hour" or "minute".

5. A timer apparatus according to claim 1, in which said light emitting device which is indicative of a timer working hour is of a different color from the light emitting device which is luminous when a "minute" of said timer working hour is being set.

* * * * *